US011910944B2

(12) United States Patent
Orlansky

(10) Patent No.: US 11,910,944 B2
(45) Date of Patent: Feb. 27, 2024

(54) DECORATIVE MEZUZAH CASING

(71) Applicant: David Orlansky, Brooklyn, NY (US)

(72) Inventor: David Orlansky, Brooklyn, NY (US)

( * ) Notice: Subject to any disclaimer, the term of this patent is extended or adjusted under 35 U.S.C. 154(b) by 329 days.

(21) Appl. No.: 17/401,650

(22) Filed: Aug. 13, 2021

(65) Prior Publication Data

US 2023/0047161 A1 Feb. 16, 2023

(51) Int. Cl.

| | |
|---|---|
| ***A47G 33/00*** | (2006.01) |
| ***A45C 11/24*** | (2006.01) |
| ***A47G 29/08*** | (2006.01) |
| *A45C 11/00* | (2006.01) |

(52) U.S. Cl.

CPC ..... *A47G 33/00* (2013.01); *A45C 11/24* (2013.01); *A47G 29/08* (2013.01); *A45C 11/00* (2013.01)

(58) Field of Classification Search

CPC ..... A47G 33/00; A47G 29/08; A45C 11/24; A45C 11/00

USPC ..... 206/19

See application file for complete search history.

(56) References Cited

U.S. PATENT DOCUMENTS

| | | | | |
|---|---|---|---|---|
| 6,006,900 | A * | 12/1999 | Hasten | A47G 33/00 206/232 |
| 6,702,107 | B1 * | 3/2004 | Raz | A47G 33/00 D99/25 |
| 2010/0044248 | A1 * | 2/2010 | Koby | A47G 33/00 206/223 |

* cited by examiner

*Primary Examiner* — Jacob K Ackun

(74) *Attorney, Agent, or Firm* — Israel Nissenbaum; Yitzy Nissenbaum

(57) ABSTRACT

A mezuzah having a decorative appearance changeable by a user. The mezuzah comprises a mezuzah casing comprised of an elongated receptacle having at least one opening configured and dimensioned to permit insertion and retention of a parchment klaf therein. At least one decorative cover is configured to close each opening with a secure attachment. The mezuzah casing is configured to be fastened to a door post with at least one fastening element into a position with an opening facing away from the doorpost. The decorative cover is removably securely attached to the mezuzah casing with a structural mechanism to prevent unwanted lateral movement and unwanted removal of the decorative cover relative to the mezuzah casing. As a result, the decorative cover is removable and replaceable, as desired.

8 Claims, 7 Drawing Sheets

DECORATIVE MEZUZAH CASING

FIELD OF THE INVENTION

This invention relates to Jewish religious casings affixed to door posts called "mezuzahs" and particularly to decorative mezuzah casings.

BACKGROUND

Mezuzahs are Jewish religious articles which are affixed to all door posts of a house or room of specific size as a spiritual protection (excepting small closets and bathrooms) whether on a door jamb or a simple doorway structure or basically on the side (usually the right side) of an entrance (collectively referred to herein as "door posts"). They are each generally comprised of a small elongated hollowed out coffin-like casing receptacle (usually from about four to eight inches in length though some are smaller or larger) into which a specific hand-written scriptural writing (on parchment or "klaf") is inserted. The entire article of casing receptacle or casing and klaf is known as a mezuzah and the receptacle itself is the mezuzah casing.

Before installation, the casing is closed, with inserted klaf, usually with a press fit closure element, to retain the klaf therein and the mezuzah is firmly affixed to a doorpost according to proscriptions of Jewish law, invariably with the insertion opening facing the door jamb to ensure secure retention of the klaf therein and with the closed casing base facing outwardly. The press fit element is most often positioned flush with the sides of the open end of the casing to enable planar or flush fit of the press fit element or the edges of the casing with the door jamb, for stability. The affixation elements are also positioned to only permit the mezuzah to be fastened to the door post with the insertion opening adjacent the door post. The only requirement is that the klaf be affixed to a door post, with protective casings of any size and configuration being acceptable and such protective casings prevent impermissible degradation and/or damage to the klaf and the written text therein.

Many modifications exist, within basic proscribed parameters, including omission of the closure element or the closure element simply being of paper (with the door jamb itself providing the closure function) or with variations in structure such as open-end tubes and cylinders and variations in material including materials such as wood, glass, leather, stone, ceramic, plastic, composite materials and metal. In terms of structure, the rectangular casing configuration is the most traditional and is accordingly, the most prevalent.

The mezuzah casings, particularly those with outwardly facing mezuzah casing bases, are often made decorative since they are prominently displayed (on the upper third of door posts) and highly visible (some are literally recognized works of art) with a fixed appearance, often with traditional Hebrew lettering thereon. Typically, a mezuzah case comprises two parts, the hollowed out longitudinal closed end channel or rectangular box or receptacle with an open side (for insertion into and retention of the klaf), and a retention cover configured for placement against the door jamb, with door post affixation elements (nail or screw hole collars used with nails or screws, Velcro® fasteners, glue and the like) on or adjacent the closure element. Since a klaf in a mezuzah is required to be inspected twice every seven years for text deterioration, the mezuzah must be able to be removed from the door post to permit such inspection.

As a sign of affection and piety, the mezuzahs are typically touched while a person enters or exits the adjacent doorway with the touching finger(s) being kissed. The mezuzahs are thus subject to normal manual degradation. Because of such constant touching and handling, the base of the casing, which has structural integrity, typically faces outwardly. Mezuzahs are invariably of a single non-changing appearance even though they may be initially custom designed. Decorative change of mezuzahs, which are in prominent visible positions, is almost always effected by procurement and replacement of the entire mezuzahs with differently decorated mezuzahs or ones with a fresher appearance.

SUMMARY

Generally, the invention comprises a method for changing decorative appearance of a mezuzah casing and a mezuzah casing embodying such method. In accordance with such method a mezuzah is configured for change of decorative appearance, with the steps of:

a) configuring a mezuzah casing with a fastening structure for attachment to a door post;
b) providing the mezuzah casing with a removable decorative section in a position on an outwardly visible portion thereof when affixed to a door with the fastening structure;
c) configuring the mezuzah casing with a structural mechanism which restricts unwanted lateral movement and outward removal of the removable decorative section removable decorative section from an initial position;
d) optionally including a structural mechanism to facilitate desired removal and replacement of the removable decorative section; and
e) attaching the mezuzah casing to a door post and removing and replacing the decorative section as desired.

The device generally comprises a mezuzah having a decorative appearance changeable by a user, the mezuzah comprises a mezuzah casing comprised of an elongated receptacle having at least one opening configured and dimensioned to permit insertion and retention of a parchment klaf therein. At least one decorative cover is configured to close each opening with a secure attachment. Though three sides are externally exposed, the side most often provided with a decorative appearance is the most forward and visible one opposite the door post though all three sides may be similarly provided with replaceable decorative covers. The mezuzah casing is configured to be fastened to a door post with at least one fastening element into a position with an opening facing away from the doorpost. The decorative cover is removably securely attached to the mezuzah casing with a structural mechanism to prevent unwanted lateral movement and unwanted removal of the decorative cover relative to the mezuzah casing. As a result, the decorative cover is removable and replaceable, as desired.

The removable decorative section is, in an embodiment, a decorative cover for an opening in the mezuzah casing through which the klaf is inserted. In a further embodiment the structural mechanism for restricting unwanted lateral movement comprises at least one outward extension of the mezuzah casing closely laterally peripheral to the removable decorative section inserted into the mezuzah casing. This is normally in the form of a recessed encircling wall section adjacent the opening in the mezuzah casing but may be individual small extensions from the mezuzah casing. The structural mechanism which restricts unwanted outward removal of the decorative section comprises, in embodiments, a releasable fastening engagement between the mezuzah casing and the removable decorative section such as magnetic elements, clips, hook and eye fasteners, releasable latch and the like In an embodiment, a mezuzah casing comprises an elongated receptacle having an opening configured and dimensioned to permit insertion and retention of a parchment klaf therein, wherein the mezuzah casing is configured to be fastened to a door post with at least one fastening element in a position with the opening facing away from the doorpost and wherein the opening is removably securely closed with a decorative cover which is replaceable, as desired.

In a further embodiment of the invention, a mezuzah casing, configured for doorpost affixation, is comprised of removable and replaceable outwardly visible elements (ideally when in position on a doorpost but not precluding removal of the mezuzah casing from the door post for replacement of the visible elements and proper repositioning). The mezuzah casing is configured, in an embodiment, with an open exposed side which is securely covered with a replaceable decorative cover which is affixed such that it is not moved out of position or damaged with the manual manipulation to which a mezuzah is normally exposed. With a rectangular configuration, a mezuzah has three exposed sides (and two ends) of which all or some may be opened for decorative closure thereof. The cover, since it is removably attached, must be provided with a secure affixation which is not susceptible to movement (particularly lateral) or damage with manual manipulation or touching of the mezuzah. In such embodiment the casing is ideally initially fixed to the door post and then the klaf is then inserted through the open exposed side prior the placement of the decorative cover.

An opening or gap in the encircling wall section is sized for finger insertion and lifting is ideally optionally provided to facilitate manual removal of the decorative cover for replacement of the decorative cover or for insertion of the klaf.

Secure affixation means for the cover includes, for example, adjacently fitting magnetic elements, hook and eye fasteners (commonly known as Velcro®), clips, and other secure mounting elements with the cover and mezuzah casing being configured with cooperative fastening elements.

The above structural configurations are further illustrated and described in the following discussion and the drawings in which:

SHORT DESCRIPTION OF THE DRAWINGS

DETAILED DESCRIPTION

Figure 1:
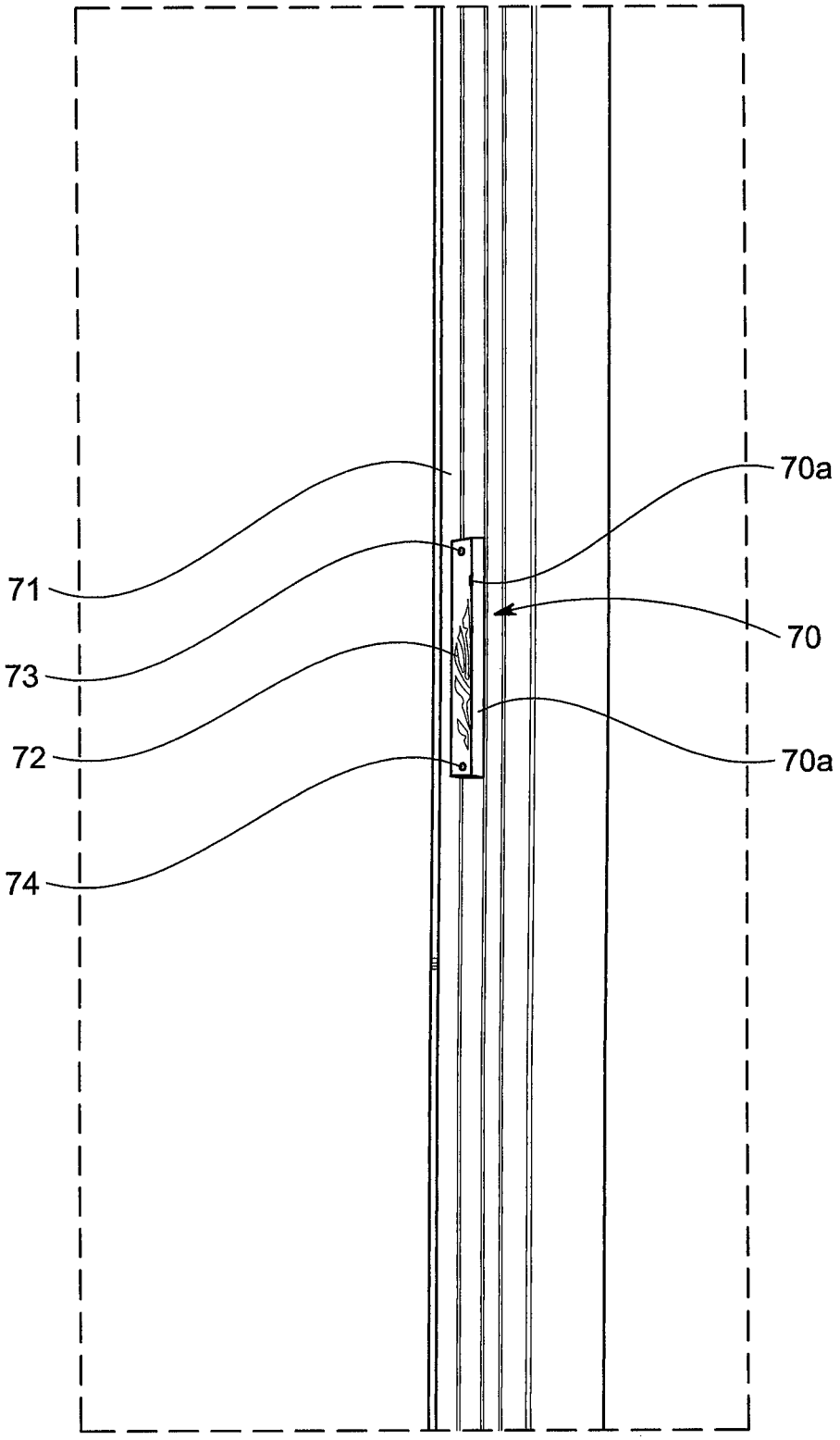
FIG. 1 (PRIOR ART)
FIG. 1 is a view of a prior art mezuzah affixed to a door post.

In a common configuration, the mezuzah is comprised of an elongated generally rectangular casing with a closed base and an open top or side, with the mezuzah casing, in one embodiment, being provided with a reverse (relative to standard prior art mezuzahs) affixation structure with protruding ears in line with the closed base and on a mounting surface of a door post or jamb. Alternatively, the base element is non visibly internally perforated for insertion of a screw, nail, clip or other affixation device, or externally provided with a magnetic or Velcro® affixation member in conjunction with a cooperative fastening element on the door post or jamb (in such embodiment the casing is affixed to the door post first and the kalf is inserted thereafter and the cover placed to ensure retention of the klaf within the casing). The closure element has an outer decorative appearance and is securely removably fastened to the casing. Examples of decorative appearances include relevant Hebrew lettering, landscapes, such as of Jerusalem and various religious themes or simply aesthetic geometric designs and colors. The closure element length is a full length of the mezuzah with a large decorative area though it may be shorter, provided that it allows a klaf to be inserted into the interior of the casing. Since the closure element is a structural element it should have structural integrity, particularly to resist the manual touching typical of mezuzahs particularly if positioned on the outermost portion of the mezuzah casing most typically subject to manual touching.

In another embodiment, the mezuzah casing comprises an open box element for placement and retention of the requisite klaf and a cover for closing the open end which is configured for placement directly against the door post or jamb with installation (this cover can be dispensed with if the door post or jamb provides the closure function). In a supplemental embodiment configuration or as a separate embodiment, a closed base or peripheral sides of the open box element is provided with an indentation area rather than a full opening, configured for insertion of a separate casing swatch of material for interchangeable decorative looks or usage. In this embodiment, the klaf is inserted through an opening positioned against the door post and the swatch material serves as a cover for the indentation. With this configuration, a further optional component for enhanced secure placemen of the swatch, comprises a frame element that is attached to the indented base with the use of magnetic elements or similar non-visible fastening elements or even with a frictional fit. It further comprises a space cut-out to allow a modular interchangeable decorative swatch of various materials to be placed inside and viewed/touched from outside.

The interchangeable modular swatch or panel may also be connected with magnets or similar types of fasteners. The placement of these modular swatches, made of various materials, are separable interchangeable elements which can be provided separately from the other two components of the main base and frame components. In an embodiment, there are additional magnets inside the base which attach to magnets (or a magnet/magnetic metal interface) which are on the interchangeable customizable swatches to help keep them in place.

The swatches may be made of cloth, leather, metal, antibacterial rubber or similar materials, LED light strips, small art/paintings, etc. The swatch/modular component panel may comprise multiple options which can be designed to match people's decor, and which look unique, feel unique to the touch, and allow the user to switch it out as desired. The interchangeable panels may be available in many other materials as well, such as colored/see-through Lucite®, textured glass, and generally any other material which can be designed to look interesting or be textured to feel unique when touched. Useful components such as an LED strip, a small digital screen panel with changing images, an anti-bacterial swatch, and similar swappable components may be made separately available as the modular component as well. The mezuzah may vary in a several sizes and shapes, such as a rectangle version and an oval version.

With the above embodiments a user customized/customizable mezuzah is possible, as opposed to a number of mezuzahs currently on the market that a company might offer to stylize/customize a finish, material or color in-house and then ship the final product to a customer. The current embodiments allow the end-user to easily attach and detach swappable front designs with covers/lids/interchangeable panels of various materials and styles. The configuration and design allows them to also be used on indoor or outdoor doorways with internal screws or double sided tape mounting, and an internal capped scroll holder. The front interchangeable panels attach to the main case with, ideally, magnets being placed in cavities at each end.

With specific reference to the drawings, FIG. 1 depicts a prior art mezuzah 70 affixed to a door post 71. The mezuzah 70 with casing 70*a* has decorative styled Hebrew lettering 72 on casing base 70*b*. The casing is affixed to door post 71 with edge nails 73 and 74 which extend through a hollow in the casing (not visible) and into the door post 71. The nails 73 and 74 are close to terminal ends of the casing 70*a* so as not to perforate a klaf (not shown) contained thereon.

Figure 2:
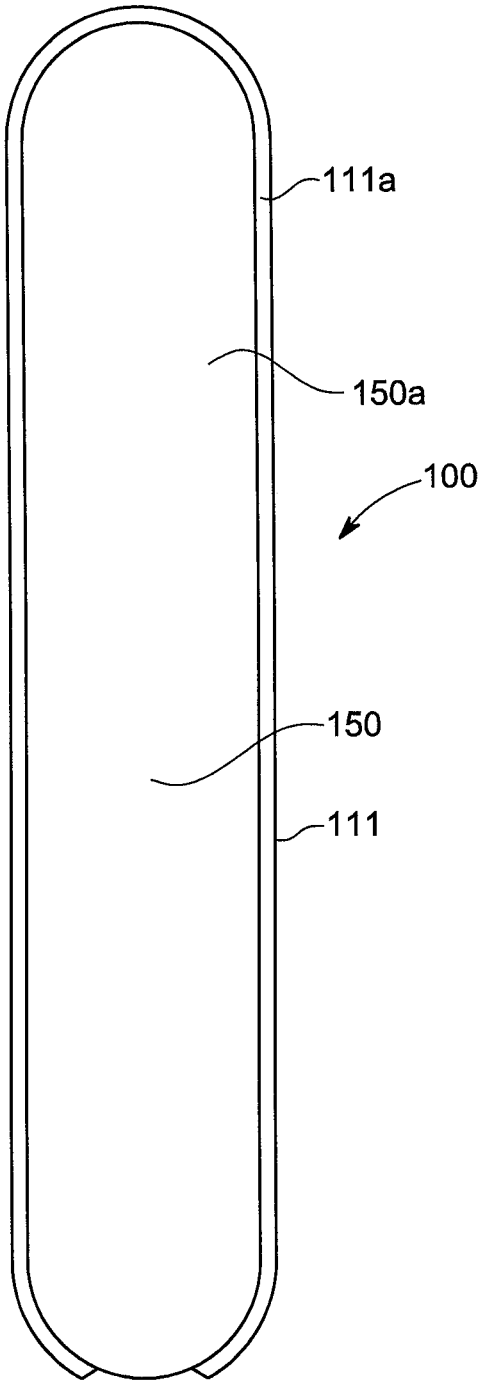
FIG. 2 is a front view of an embodiment of the mezuzah casing with a blank cover element.
Figure 3:
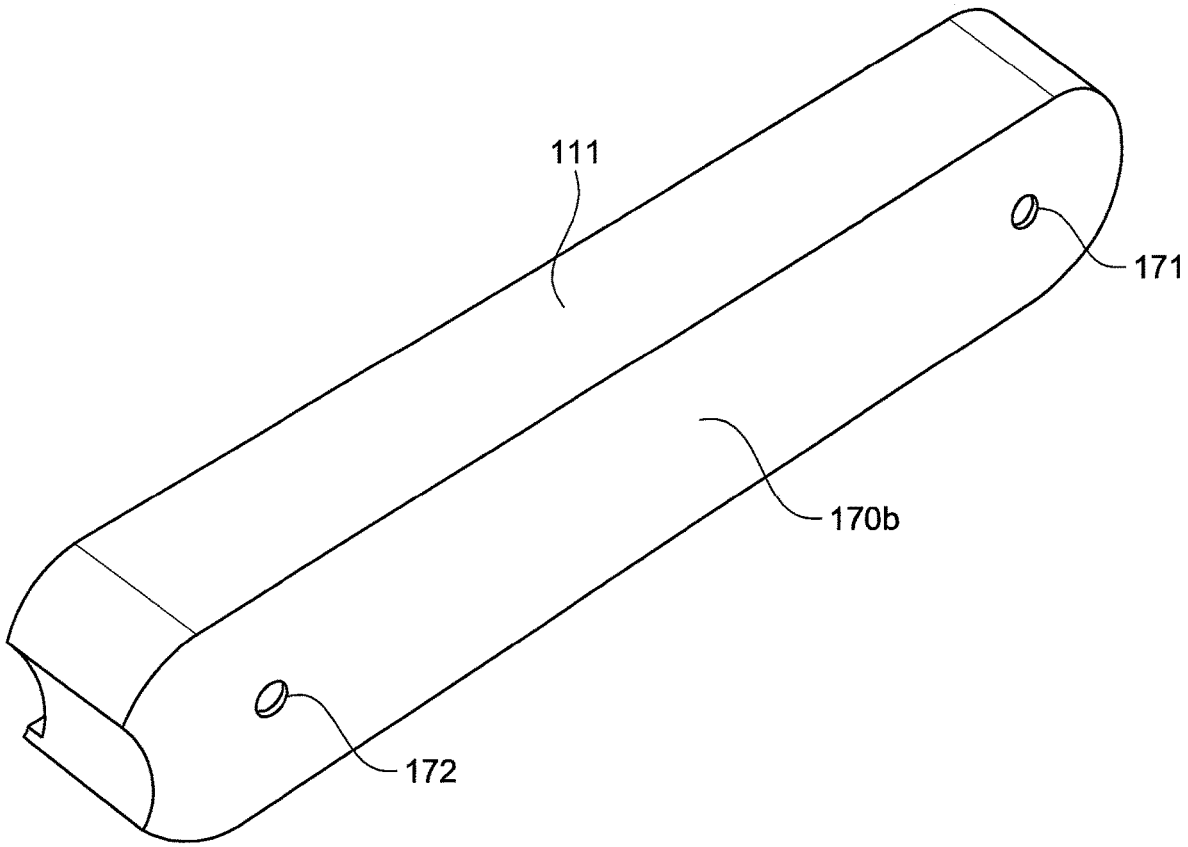
FIG. 3 is a rear perspective view of the mezuzah of FIG. 2.
Figure 4:
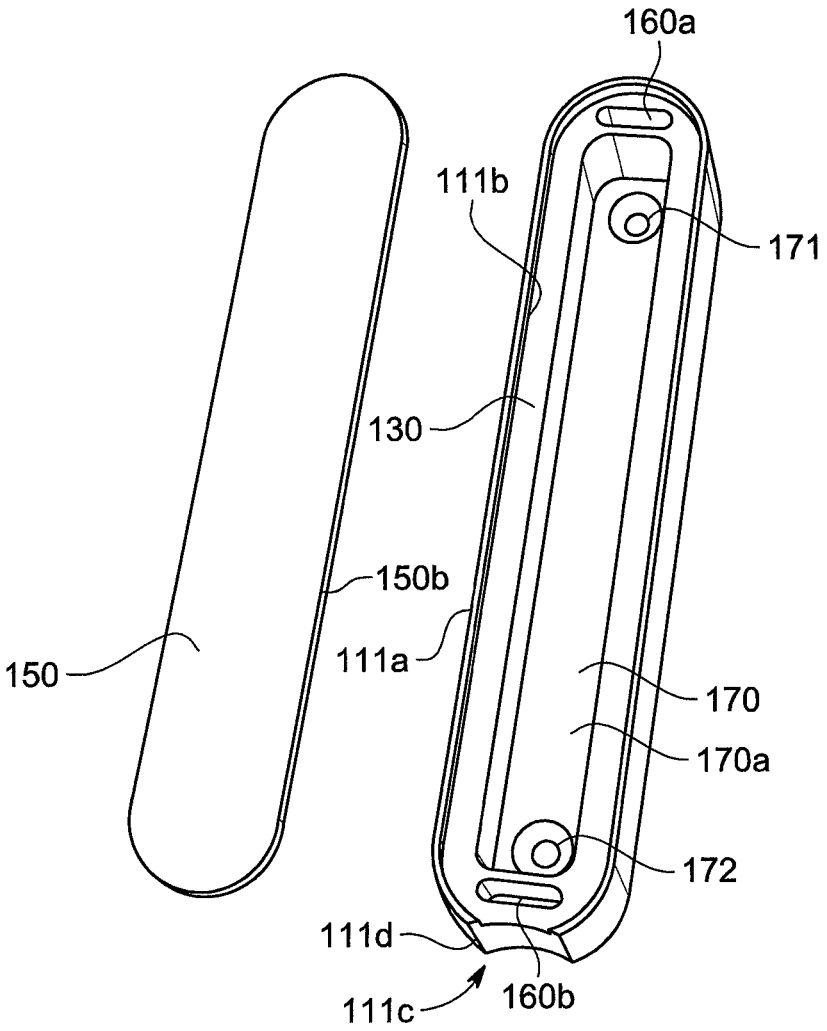
FIG. 4 is an upward perspective view showing the mezuzah casing interior with adjacent removed decorative cover.
Figure 5:
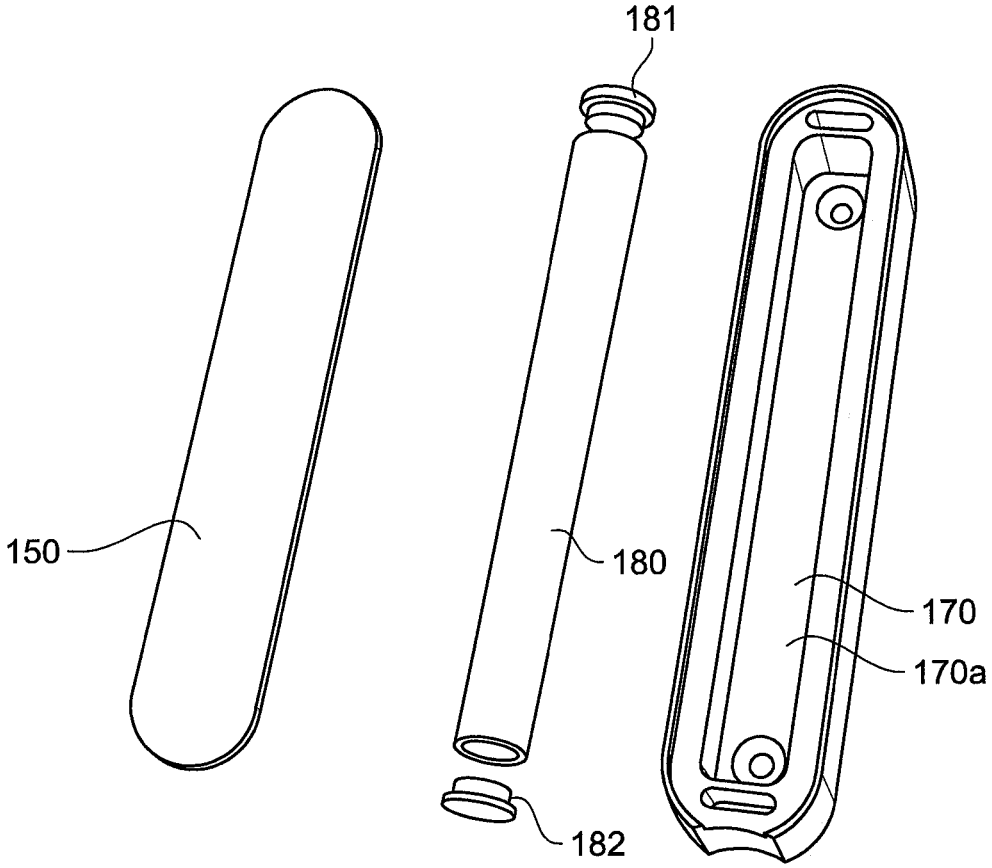
FIG. 5 is the mezuzah casing and cover of FIG. 4 with the klaf container for insertion of the klaf and fitting within the cavity of the casing.

FIG. 2 depicts a front view of a mezuzah 100 with casing 111 and decorative removable replaceable cover 150 (with decorative side 150*a* shown in blank as a design embodiment). Peripheral edge 111*a* extends, with a recess 111*b* and supporting ledge 130, visible more clearly in FIG. 4, to laterally retain cover 150 therein, and in a secure resting position. Apertures 160*a* and 160*b* are configured to hold fastening elements such as magnets (not shown) which cooperate with corresponding fastening materials such as metal (for a magnetic connection) on the non-decorative side 150*b* of cover 150. Section 111*c* is a gap in peripheral ledge 111*a* and indent 111*d* which permits finger insertion for removal of cover 150 for replacement. Open recess 170 is sized to fully contain klaf retaining cylinder 180 shown in FIG. 5. In FIG. 5, cylinder 180 is shown with removable caps 181 and 182 though which a klaf (not shown is inserted). It is understood that the cylinder is for additional protection of the parchment of the klaf since the mezuzah casing is openable for cover replacement. It can however be dispensed with if desired. Screw hole apertures 171 and 172 are shown as being in the base 170*a* of recess 170 for screw insertion and fastening of the mezuzah case to a door post. Flat head screws (not shown) are used to avoid any protrusion into the volume of recess 170 and interference with the subsequently placed klaf or klaf retaining cylinder. FIG. 3 shows the rear base 170*b* of mezuzah casing 111 with the screw insertion openings 171 and 172 which are brought adjacent to a door post for affixation thereto.

Figure 6:
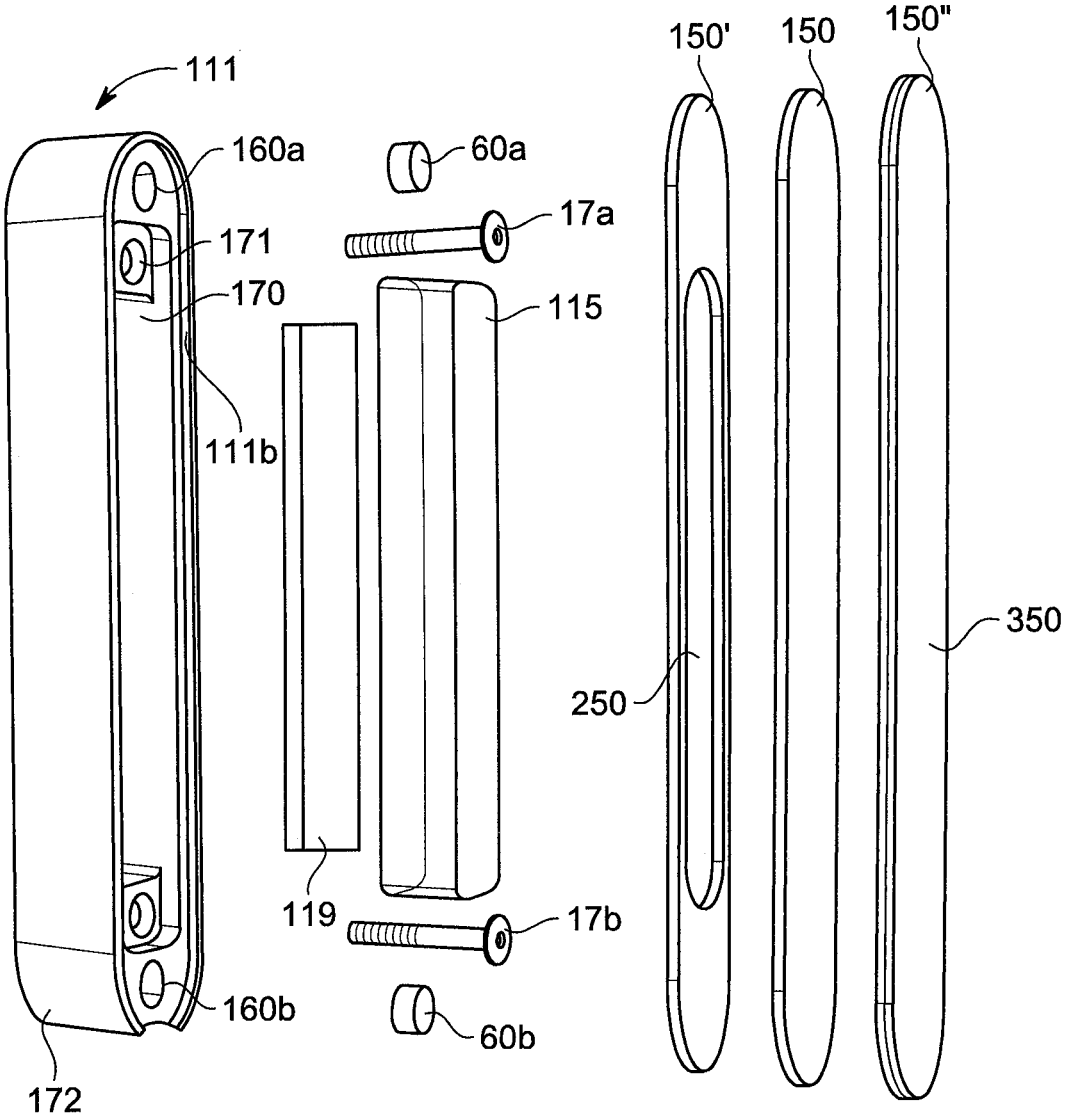
FIG. 6 is a mezuzah with casing of FIGS. 2-5 in exploded view with alternative cover elements.

FIG. 6 shows, in exploded view, a mezuzah casing 111, a klaf 119, klaf protective container 115, magnetic elements 60*a* and 60*b*, and affixation screws 17*a* and 17*b*. Mezuzah casing 111 has cavities 160*a* and 160*b* for retention of circular magnets 60*a* and 60*b* and screw holes 171 and 172 for insertion of door post retention screws 17*a* and 17*b* respectively. Klaf 119 is fitted within (optional) protective case 1115 which is sized to fit within receptable space 170. Cover 150' embodies magnetically attractive metal for removable retention on mezuzah casing 111 with magnetic elements 60*a* and 60*b* seated in a position flush and adjacent inserted cover 150'. Cover 150' has an opening 250 of sufficient size to permit direct viewing of an inserted klaf (as desired by some). Cover 150 is of magnetic metal and completely covers the interior of the mezuzah casing and fits within movement retaining wall extension 111*a*. Cover 150" is dual sided with an ornamental leather exterior 350 and an inner magnetic metal layer. All the covers 150, 150' and 150" are shown with different ornamental configurations but all of which have identical outer dimensions for interchangeable fitment within extending recess 111*b*.

Figure 7:
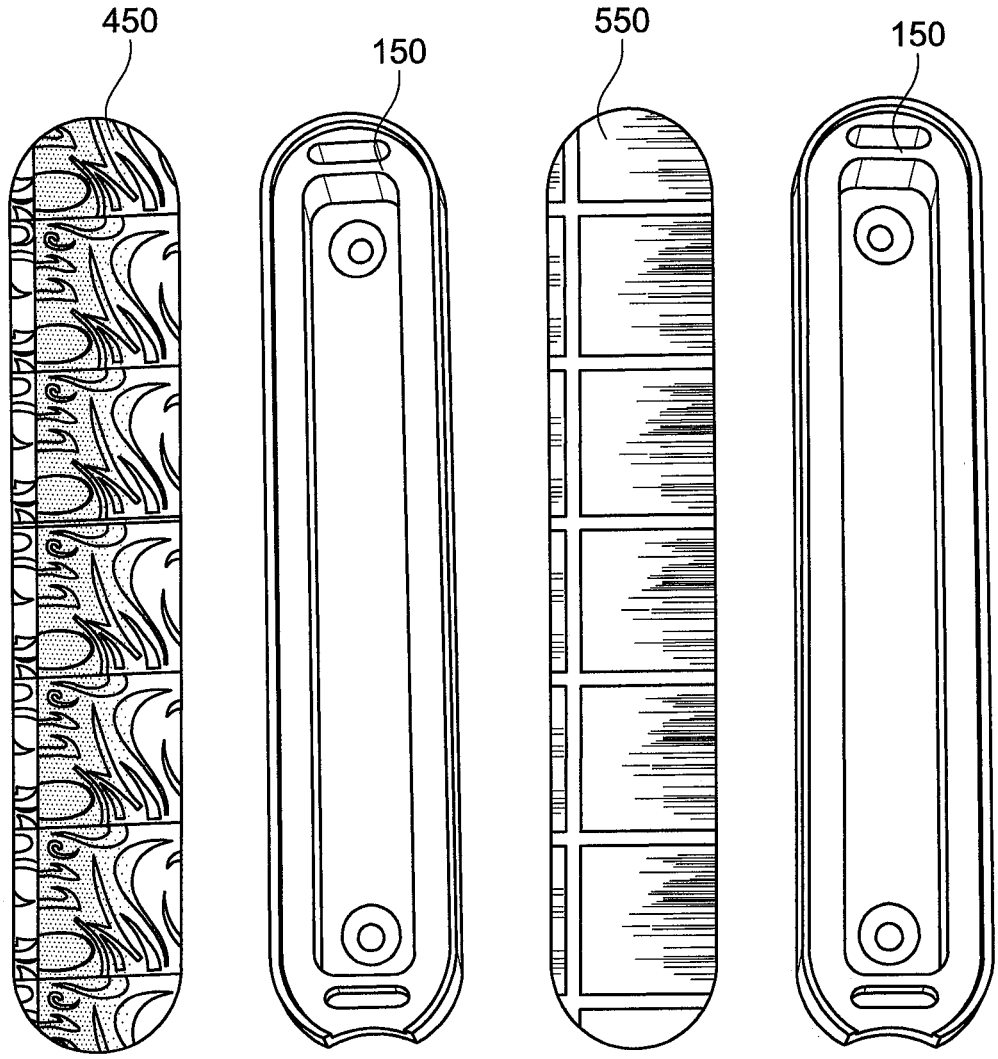
FIG. 7 is a view of two mezuzah casings with different replaceable decorative closure covers.

FIG. 7 illustrates two mezuzah casings 111 with different ornamental covers 450 and 550 with both covers fitting on each of the casings and being alternatively used on a single mezuzah casing.

It is understood that the above description and drawings are only illustrative of the invention with changes in structure and material being possible without departing from the scope of the invention as defined in the following claims.

What is claimed is:

1. A mezuzah having a decorative appearance changeable by a user, the mezuzah comprising a mezuzah casing comprised of:

a. an elongated receptacle having at least one opening configured and dimensioned to permit insertion and retention of a parchment klaf therein, and b. at least one decorative cover configured to close the respective at least one opening each with a secure attachment, wherein the mezuzah casing is configured to be fastened to a door post with at least one fastening element into a position with the respective at least one opening facing away from the doorpost and wherein the at least one decorative cover is removably securely attached to the mezuzah casing with a structural mechanism to prevent unwanted lateral movement and unwanted removal of the at least one decorative cover relative to the mezuzah casing and wherein the at least one decorative cover is removable and replaceable, as desired, wherein the receptacle comprises a recessed encircling wall section defining the at least one opening and wherein the respective at least one decorative cover is sized to snugly fit within and adjacent recessed encircling wall, wherein a ledge inwardly peripheral to walls of the mezuzah casing is sized and positioned to support the respective decorative cover in position adjacent the recessed encircling wall section to prevent the unwanted lateral movement and wherein a holding structure between the ledge and the decorative cover removably holds the cover against the unwanted removal of the decorative cover, and wherein a cavity is formed by the ledge with sufficient space for placement of the parchment klaf therewithin.

2. The mezuzah of claim 1, wherein the recessed encircling wall section comprises a gap sufficient for insertion of a finger beneath the decorative cover for application of outward pressure for removal of the decorative cover.

3. The mezuzah of claim 1, wherein the elongated receptacle of the mezuzah casing comprises a base having perforations therethrough for insertion of a fastening member for attachment to a door post without being externally visible.

4. The mezuzah of claim 1, wherein the replaceable decorative cover has an opening therein for outside viewing of the contained klaf.

5. The mezuzah of claim 1, wherein the holding structure comprises a magnetic element structure.

6. A method for changing decorative appearance of a mezuzah casing comprising the steps of:

a) configuring a mezuzah casing with a fastening structure for attachment to a door post;

b) providing the mezuzah casing with a removable decorative section in a position on an outwardly visible portion thereof when affixed to a door with the fastening structure;

c) configuring the mezuzah casing with a structural mechanism which restricts unwanted lateral movement and outward removal of the removable decorative section removable decorative section from the position, wherein the structural mechanism comprises a recessed encircling wall section defining the at least one opening and wherein the respective at least one decorative cover is sized to snugly fit within and adjacent recessed encircling wall, and wherein a ledge inwardly peripheral to walls of the mezuzah casing is sized and positioned to support the respective decorative cover in position adjacent the recessed encircling wall section to prevent the unwanted lateral movement and wherein a holding structure between the ledge and the decorative cover removably holds the cover against the unwanted removal of the decorative cover, and wherein a cavity is formed by the ledge with sufficient space for placement of the parchment klaf therewithin, d) optionally including a structural mechanism to facilitate desired removal and replacement of the removable decorative section; and e) attaching the mezuzah casing to a door post and removing and replacing the decorative section as desired.

7. The method of claim 6, wherein the holding structure comprises a magnetic element structure.

8. The method of claim 6, wherein the structural mechanism to facilitate desired removal and replacement of the decorative cover comprises providing the recessed encircling wall section with a gap sufficient for insertion of a finger beneath the decorative cover for application of outward pressure for removal of the decorative cover.

* * * * *